US005311723A

United States Patent [19]

Boriani et al.

[11] Patent Number: 5,311,723

[45] Date of Patent: May 17, 1994

[54] METHOD AND DEVICE FOR SIMULTANEOUSLY CLOSING PAIRS OF BOXES

[75] Inventors: Silvano Boriani; Antonio Gamberini, both of Bologna, Italy

[73] Assignee: G. D Societa' per Azioni, Bologna, Italy

[21] Appl. No.: 904,822

[22] Filed: Jun. 26, 1992

[30] Foreign Application Priority Data

Jul. 16, 1991 [IT] Italy ..... B091A000254

[51] Int. Cl.[5] ..... B65B 7/20

[52] U.S. Cl. ..... 53/491; 53/376.4; 53/377.3

[58] Field of Search ..... 53/207, 376.4, 376.5, 53/376.6, 376.8, 377.3, 462, 491, 202

[56] References Cited

U.S. PATENT DOCUMENTS 1,622,709 3/1927 Evans et al. ..... 53/376.8 X
2,605,598 8/1952 MacKenzie ..... 53/376.8 X
4,612,752 9/1986 Deal ..... 53/377.3
4,909,020 3/1990 Focke ..... 53/202 X
4,964,260 10/1990 Focke et al. ..... 53/491 X
5,058,363 10/1991 Focke et al. ..... 53/202 X
5,174,444 12/1992 Adams et al. ..... 53/462 X

*Primary Examiner*—John Sipos
*Assistant Examiner*—Linda B. Johnson
*Attorney, Agent, or Firm*—Klauber & Jackson

[57] ABSTRACT

A method and device for simultaneously closing a first and adjacent second box having respective lateral openings, each closed by a pair of lateral tabs, which are folded one on top of the other by a first and second folding device on either side of the two boxes; the tabs being arranged, prior to folding, facing and parallel to one another, so as to define two inner tabs and two outer tabs; and each folding device moving along a respective path for folding the outer tab of the adjacent box and the inner tab of the other box.

13 Claims, 1 Drawing Sheet

METHOD AND DEVICE FOR SIMULTANEOUSLY CLOSING PAIRS OF BOXES

BACKGROUND OF THE INVENTION

The present invention relates to a method of simultaneously closing pairs of boxes.

In particular, the present invention relates to a method of folding, substantially simultaneously, two pairs of tabs forming part of two superimposed boxes.

The present invention is especially suitable for packing machines, particularly those designed for producing pairs of boxes substantially in the form of a rectangular parallelepipedon.

Purely by way of example, the following description refers specifically to cigarette manufacturing machines, in particular, cartoning machines for producing cartons of cigarettes consisting of two half cartons, each comprising a rectangular parallelepiped box normally containing a row of five packets of cigarettes, and which may or may not be joined to the box of the other half carton.

On known machines of the aforementioned type, the half cartons are produced from respective preferably substantially identical blanks, which are each folded in a U about the respective row of packets, so as to present two longitudinal or lateral tabs projecting transversely, and a number of end tabs projecting axially in relation to the packets. The end tabs are normally folded for closing the longitudinal ends of the respective half carton using known folding devices, while further known devices are used for folding the lateral tabs one on top of the other.

On known machines of the aforementioned type, due to the difficulties posed in simultaneously forming the two boxes in each carton, these are normally closed separately and then placed and joined one on top of the other to form the finished carton. The major difficulty encountered in this respect is in folding the lateral tabs when the two boxes are placed substantially one on top of the other.

SUMMARY OF THE INVENTION

It is an object of the present invention to provide a method designed to overcome the aforementioned difficulty and so enable both boxes in each carton to be formed simultaneously.

According to the present invention, there is provided a method of simultaneously closing a pair of boxes comprising a first and second box, each having a pair of lateral tabs, which are folded one on top of the other for forming the lid of the respective said box; said boxes being arranged adjacent to each other; the tabs in said two pairs of tabs being arranged, prior to folding, facing and parallel to each other, so as to define two inner tabs and two outer tabs; the two inner tabs being located between the two outer tabs; and each said box comprising one said outer tab and one said inner tab; characterized by the fact that it comprises stages consisting in feeding said boxes between first and second folding means respectively adjacent to said first and said second box and moving along respective folding paths; and in folding, via each of said folding means, the outer tab of the adjacent box and the inner tab of the other box; said inner tabs being folded successively; a first of the two inner tabs being directly accessible by the respective folding means as these travel along said respective folding path, and being folded first; and the other inner tab being made accessible by the respective folding means subsequent to folding said first inner tab.

The present invention also relates to a device for simultaneously closing pairs of boxes.

According to the present invention, there is provided a device for simultaneously closing a pair of boxes comprising a first and second box, each having a pair of lateral tabs, which are folded one on top of the other for forming the lid of the respective said box; said boxes being arranged adjacent to each other; the tabs in said two pairs of tabs being arranged, prior to folding, facing and parallel to each other, so as to define two inner tabs and two outer tabs; the two inner tabs being located between the two outer tabs; and each said box comprising one said outer tab and one said inner tab; characterized by the fact that it comprises a folding station for receiving said two boxes in said adjacent position; and first and second folding means mounted on either side of said folding station and located, in use, respectively adjacent to said first and said second box; said folding means moving along respective folding paths, for each folding the outer tab of the adjacent box and the inner tab of the other box.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
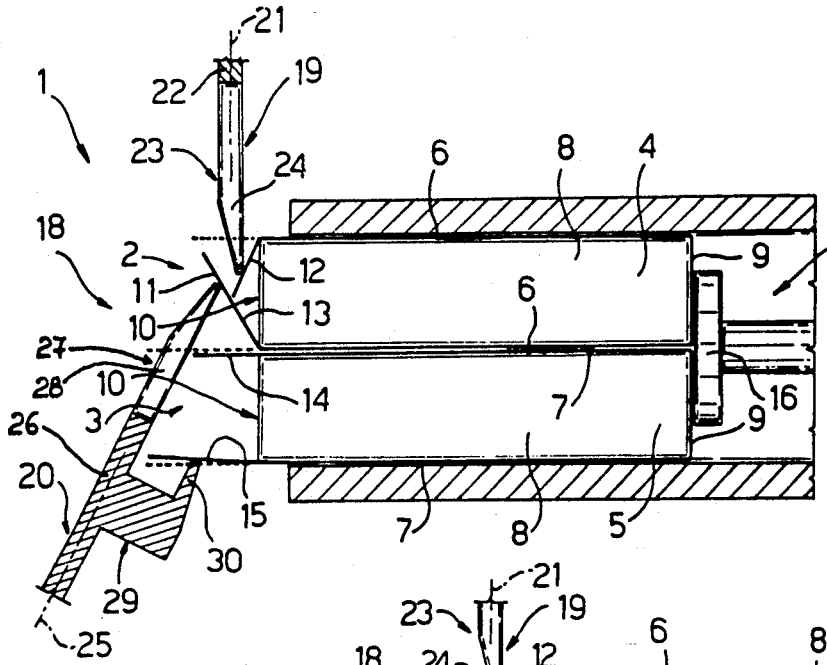
FIG. 1 schematic, partially sectioned view of a preferred embodiment of the folding device according to the present invention.

Number 1 in FIG. 1 indicates a device for folding, substantially simultaneously, two pairs 2 and 3 of tabs forming part of two respective adjacent, more specifically superimposed, boxes 4 and 5.

Each box 4, 5 is substantially in the form of a rectangular parallelepipedon, and comprises two large lateral panels 6 and 7 connected at each longitudinal end by two end panels 8 (only one of which is shown in FIG. 1), and at the transverse end by a small lateral panel 9.

On the opposite side to panels 9, boxes 4 and 5 present respective openings 10 closed by respective lids 11, each defined by a respective pair 2, 3 of tabs folded one on top of the other by device 1.

More specifically, tab pair 2 of box 4 comprises two tabs 12 and 13, the second wider than the first, and both projecting outwards from the longitudinal edges of respective panels 6 and 7 opposite those connected to panel 9; while tab pair 3 of box 5 comprises two tabs 14 and 15, the second wider than the first, and both projecting outwards from the longitudinal edges of respective panels 6 and 7 opposite those connected to panel 9. Prior to folding, tabs 12, 13 and 14, 15 are coplanar to respective panels 6, 7, and project laterally outwards on either side of respective opening 10.

For closing openings 10, boxes 4 and 5 are fed by a push device 16 along a conduit 17 to a folding station 18, wherein box 4 is arranged on top of box 5, with panel 7 of box 4 contacting panel 6 of box 5; with tabs 12, 13, 14 and 15 arranged parallel and facing one another; and with tabs 13 and 14, hereinafter referred to as the "inner tabs", arranged contacting each other and between tabs 12 and 15, hereinafter referred to as the "outer tabs".

Figure 2:
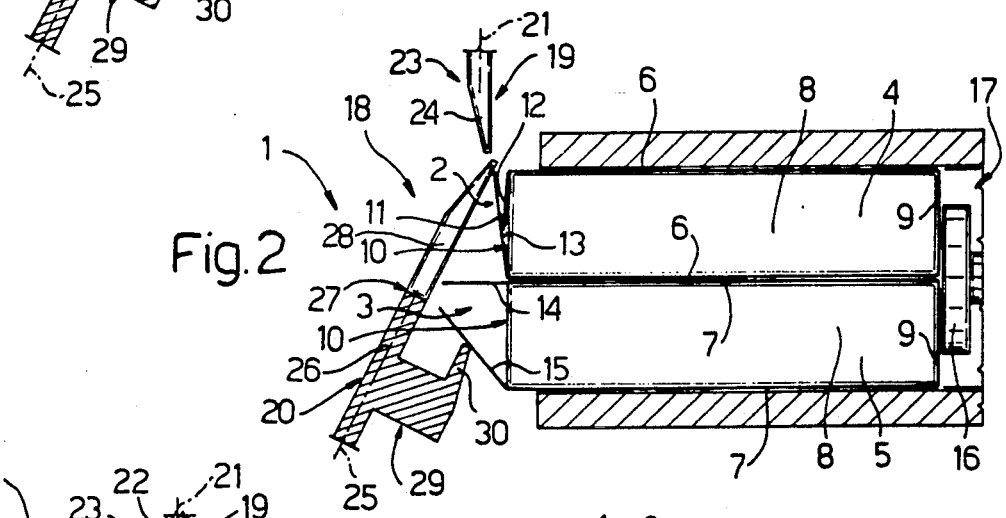
FIGS. 2 and 3 show the FIG. 1 device in two different operating positions.
Figure 3:
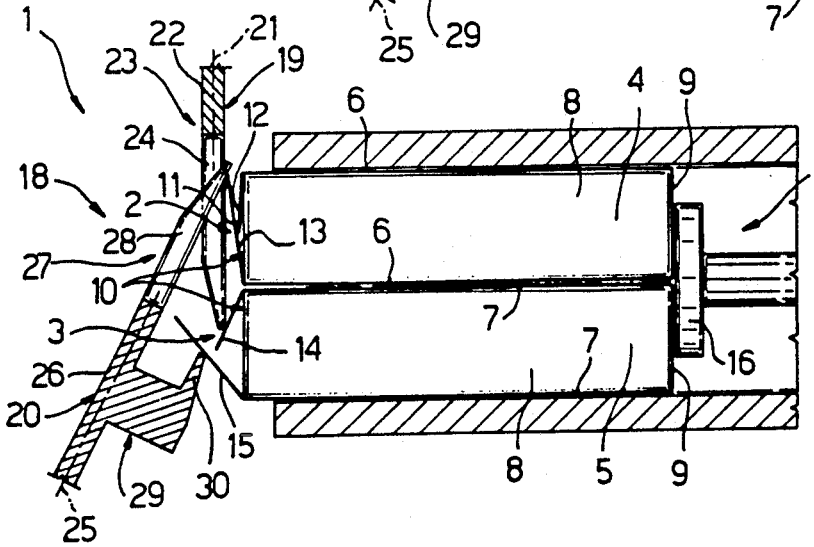

As shown in FIGS. 1 to 3, folding station 18, which forms part of device 1, comprises a first and second folding device 19 and 20 located on either side of and respectively adjacent to boxes 4 and 5 in station 18.

Top folding device 19 is moved back and forth by known actuating means (not shown) along a straight folding path 21 perpendicular to panels 6 and 7, and comprises a rod 22 fitted on its free end with a comb 23 having a number of equally-spaced teeth 24, and which provides for squarely folding tabs 12 and 14 of respective boxes 4 and 5, which, as already stated, are narrower than respective tabs 13 and 15.

Bottom folding device 20 is substantially fork-shaped, and moved back and forth by known actuating means (not shown) along a straight path 25 sloping in relation to path 21 of folding device 19. Device 20 comprises a rod 26 fitted on its free end with a comb 27 constituting a first end portion of said fork and having a number of equally-spaced teeth 28 designed to engage between teeth 24 of device 19, for squarely folding tab 13 of box 4 on to tab 12. Rod 26 also presents a substantially L-shaped appendix 29 extending towards box 5 substantially from the base of teeth 28 and comprising an end portion 30 constituting a second end portion of said fork. Portion 30 is parallel to teeth 28 and path 25, and provides for engaging and folding tab 15 of box 5 on to respective tab 14.

For folding tab 13 of box 4 on to respective tab 12, and tab 15 of box 5 on to respective tab 14, devices 19 and 20 are moved from an idle position, wherein they are located a given distance from boxes 4 and 5, along respective paths 21 and 25 toward boxes 4 and 5.

The operating sequence of devices 19 and 20 consists, firstly, in lowering device 19 so that teeth 24 engage and fold outer tab 12 of box 4 down by an angle of substantially more than 45°. Once outer tab 12 of box 4 is partially folded as described above, device 20 is moved along oblique path 25 towards inner tab 13, which is engaged by teeth 28 on the end portion projecting transversely in relation to inner tab 14 of box 5 (FIG. 1). As it continues along oblique path 25, device 20 (FIG. 1) brings the inner surface of inner tab 13 of box 4 into contact with the free end of partially folded outer tab 12, and folds inner tab 13 squarely on to outer tab 12, while device 19 (FIG. 2) is withdrawn into the idle position for enabling tab 13 to be folded down on to tab 12.

During the latter movement, appendix 29 (FIG. 2) contacts outer tab 15 of box 5, which it begins to fold towards box 4, while device 19 is again lowered so as to engage teeth 24 between teeth 28 and so partially fold inner tab 14 now made accessible by inner tab 13 already being folded. Once inner tab 14 is partially folded, device 19 is arrested, and device 20 moved forward for squarely folding outer tab 15 on to inner tab 14 by means of appendix 29.

Clearly, therefore, both boxes 4 and 5 may be closed extremely simply using two folding devices 19 and 20, the extremely straightforward design of device 1 as described above being made possible by the fact that inner tabs 13 and 14 differ in width, thus making inner tab 13 of box 4 directly accessible by folding device 20 adjacent to box 5. According to variations not shown, the same may obviously be achieved using superimposed boxes having lid tabs of substantially the same width, but slightly offset in relation to each other; or by arranging tabs 13 and 14 (and respective boxes 4 and 5) slightly apart, and so inclining path 25 as to enable folding device 20 to directly contact inner tab 13.

We claim:

1. A method of simultaneously closing a pair of boxes comprising a first and second box (4, 5), each having a pair (2, 3) of lateral tabs, which are folded one on top of the other for forming the lid (11) of the respective said box (4, 5); said method comprising the steps of:

arranging said boxes (4, 5) adjacent to each other; whereby individual tabs (12, 13, 14, 15) in said two pairs (2, 3) of tabs are arranged, prior to folding, facing and parallel to each other, so as to define a series of tabs with two inner tabs (13, 14) relative to said series and two outer tabs (12, 15), relative to said series; wherein the two inner tabs (13, 14) are located between the two outer tabs (12, 15); wherein each of said first and second box (4, 5) comprises one of said outer tabs (12, 15) and an inner tab closest thereto, respectively (13, 14);

adjacently stationarily positioning said boxes (4, 5) between first and second folding means (19, 20) with said first and second folding means being adjacent to said first and said second box (4, 5) respectively and moving said first and second folding means along separate folding paths (21, 25) relative to the stationarily positioned boxes;

folding, via each of said folding means (19, 20), the outer tab (12; 15) of the box (4; 5) adjacent thereto and the inner tab (14; 13) of the other box (5; 4); wherein said inner tabs (13, 14) are folded successively; with a first (13) of the two inner tabs (13, 14) being directly accessible by the second folding means (20) as the second foldings means (20) travels along its folding path (25), and said first inner tab (13) being folded first; and wherein the other inner tab (14) is directly inaccessible by the first folding means, until said first inner tab is folded by said second folding means, with the other inner tab (14) being made accessible to the respective folding means (19), subsequent to folding of said first inner tab (13); with said other inner tab (14) being folded thereafter.

2. A method as claimed in claim 1, wherein the path (21) of said first holding means (19) is perpendicular to said tabs (12, 13, 14, 15) prior to their being folded.

3. A method as claimed in claim 1, wherein said first folding means (19) is moved back and forth along its path (21); and wherein the outer tab (12) of the first box (4) and the inner tab (14) of the second box (5) are folded in the course of two successive reciprocating movements of said first folding means (19), to and from an idle position at a pre-determined distance from the first box (4).

4. A method as claimed in claim 1, wherein the path (25) of said second folding means (20) is a straight path sloping in relation to said tabs (12, 13, 14, 15) prior to their being folded.

5. A method as claimed in claim 1, wherein said second folding means (20), moving along said path (25) folds the outer tab (15) of the second box (5) and the inner tab (13) of the first box (4) in the course of one reciprocating movement of said second folding means (20), to and from an idle position at a pre-determined distance from the second box (5).

6. A method as claimed in claim 1, wherein said two paths (21, 25) intersect each other.

7. A method as claimed in claim 1, wherein the outer tab (12) of the first box (4) and the inner tab (14) of the second box (5) are folded in the course of a first and second reciprocating movement of said first folding means (19), to and from an idle position a pre-determined distance from the first box (4); and wherein the outer tab (15) of the second box (5) and the inner tab (13) of the first box (4) are folded in the course of a single reciprocating movement of said second folding means (20), to and from an idle position a pre-determined distance from the second box (5); said reciprocating movement of the second folding means (20) being effected between said first and second reciprocating movement.

8. A device (1) for simultaneously closing a pair of boxes comprising a first and second box (4, 5), each having a pair (2, 3) of lateral tabs, which are folded one on top of the other for forming the lid (11) of the respective said box (4, 5); said device comprising means for arranging and holding said boxes (4, 5) adjacent to each other whereby the individual tabs (12, 13, 14, 15) in said two pairs (2, 3) of tabs are arranged, prior to folding, facing and parallel to each other, so as to define a series of tabs with two inner tabs (13, 14) relative to said series, and two outer tabs (12, 15), relative to said series; the two inner tabs (13, 14) being located between the two outer tabs (12, 15); wherein each of said boxes (4) (5) comprises one of said outer tabs (12; 15) and an inner tab (13; 14) closest thereto, respectively; said means for arranging and holding comprising a folding station (18) for receiving said two boxes (4, 5) and fixedly holding the two boxes in position adjacent each other; said device further comprising first and second folding means (19, 20) mounted on either side of said folding station (18) and located, in use, respectively adjacent to and outside of said first and said second box (4, 5); means for moving said first and second folding means (19, 20) along respective folding paths (21, 25), for each of said first and second folding means (19, 20), to fold the outer tab (12; 15) of the box adjacent thereto (4; 5) and the inner tab (14; 13) of the other box (5; 4).

9. A device as claimed in claim 8, wherein said first folding means (19) comprises a single first folding device reciprocating along its respective path (21), and having an end portion (23) designed to engage and fold an outer tab (12), in said series, of the first box (4) and an inner tab (14), in said series, of the second box (5).

10. A device as claimed in claim 9, wherein the path (21) of said first folding device (19) is a straight path perpendicular to said tabs (12, 13, 14, 15) prior to their being folded.

11. A device as claimed in claim 9, wherein said second folding means (20) comprises a single fork-shaped folding device having first and second end portions (27, 30) extending in the same direction and facing each other; said second folding device (20) reciprocating along its respective path (25) for folding the inner tab (13), in said series, of the first box (4), via said first end portion (27), and the outer tab (15), in said series, of the second box (5), via said second end portion (30).

12. A device as claimed in claim 11, wherein the path (25) of said second folding device (20) is a straight path sloping in relation to said tabs (12, 13, 14, 15) prior to their being folded.

13. A device as claimed in claim 12, wherein said two respective paths (21, 25) intersect each other; said first end portion of said second folding device (20) and the end portion of the first folding device (19) being comb-shaped.

* * * * *